US011751737B2

(12) United States Patent
Zheng

(10) Patent No.: US 11,751,737 B2
(45) Date of Patent: Sep. 12, 2023

(54) CLEANING ROBOT

(71) Applicant: SHENZHEN SILVER STAR INTELLIGENT GROUP CO., LTD., Shenzhen (CN)

(72) Inventor: Lianrong Zheng, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 56 days.

(21) Appl. No.: 17/535,609

(22) Filed: Nov. 25, 2021

(65) Prior Publication Data

US 2022/0160194 A1 May 26, 2022

(30) Foreign Application Priority Data

Nov. 26, 2020 (CN) ..... 202011345492.X

(51) Int. Cl.
*A47L 9/00* (2006.01)
*A47L 9/28* (2006.01)

(52) U.S. Cl.
CPC ..... *A47L 9/0018* (2013.01); *A47L 9/28* (2013.01); *A47L 2201/00* (2013.01)

(58) Field of Classification Search
None
See application file for complete search history.

(56) References Cited

U.S. PATENT DOCUMENTS

2020/0138257 A1* 5/2020 Koura ..... A47L 11/4063
2020/0275817 A1* 9/2020 Nordt ..... A47L 11/24

* cited by examiner

*Primary Examiner* — Andrew A Horton
(74) *Attorney, Agent, or Firm* — Yu Gang

(57) ABSTRACT

A cleaning robot includes a machine body, a rotating component, and a cover. The machine body defines a mounting groove. The rotating component includes an outer wall, and at least a part of the outer wall is jointed with the mounting groove to form a rotating pair. The cover is fixedly connected with the rotating component, and the cover is capable of cooperating with the machine body in an opening and closing manner.

20 Claims, 12 Drawing Sheets

CLEANING ROBOT

CROSS-REFERENCE TO RELATED APPLICATIONS

The present disclosure claims priority of Chinese Patent Application No. 202011345492.X, filed on Nov. 26, 2020, titled "CLEANING ROBOT", the contents of which are incorporated herein by reference.

TECHNICAL FIELD

The present disclosure relates to the field of cleaning apparatuses, and in particular, relates to a cleaning robot.

BACKGROUND

Currently, cleaning robots are usually provided with a dust box cover that may be hinged on a machine body, for preventing a dust box from shaking during the operation of the robots and meanwhile being beautiful. Usually, a transfer piece is provided to be fixedly connected with the dust box cover, and a through hole is defined in the transfer piece, a rotating shaft is inserted into the through hole to be connected with the machine body, thereby hinging the dust box cover with the machine body. This structure has the following problems:

(1) the rotating shaft is positioned in the transfer piece, the size thereof is limited, the strength requirement for the rotating shaft is high, and it is easy to break;

(2) the installation is inconvenient, and it is necessary to insert the rotating shaft into the through hole of the machine body and the through hole of the transfer piece for installation.

SUMMARY

An embodiment of the present disclosure provides a cleaning robot. The cleaning robot includes a machine body, a rotating component, and a cover. The machine body defines a mounting groove. The rotating component includes an outer wall, and at least a part of the outer wall is jointed with the mounting groove to form a rotating pair. The cover is fixedly connected with the rotating component, and the cover is capable of cooperating with the machine body in an opening and closing manner.

DETAILED DESCRIPTION

Directional terms mentioned or possibly mentioned in this specification, such as upper, lower, left, right, forward, backward, front, back, top and bottom, are defined relative to constructions thereof, and are relative concepts. Therefore, it is possible to make corresponding changes according to different positions and different use states. Therefore, these or other directional terms should not be interpreted as restrictive terms.

Embodiments described in the following exemplary examples do not represent all embodiments consistent with the present disclosure. Rather, they are merely examples consistent with some aspects of the present disclosure as detailed in the appended claims.

Terms used in the present disclosure are only for the purpose of describing specific embodiments, and are not intended to limit the present disclosure. As used in the present disclosure and the appended claims, the singular forms "a", and "the" are intended to include the plural forms as well, unless the context clearly indicates otherwise. It shall also be appreciated that, the term "and/or" as used herein refers to and includes any or all possible combinations of one or more associated listed items.

Figure 1:
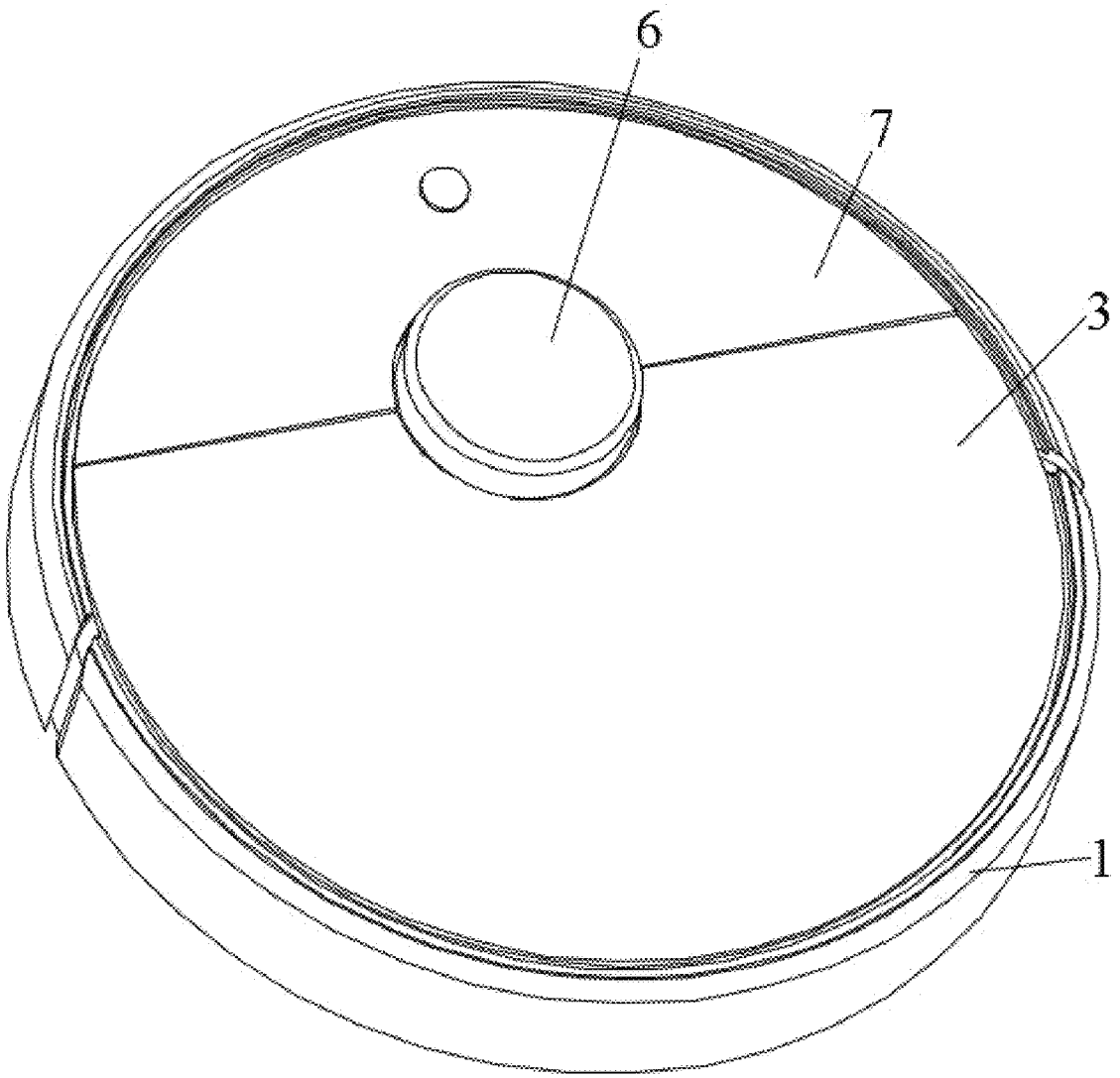
FIG. 1 is a schematic structural view of a cleaning robot according to an embodiment of the present disclosure.
Figure 2:
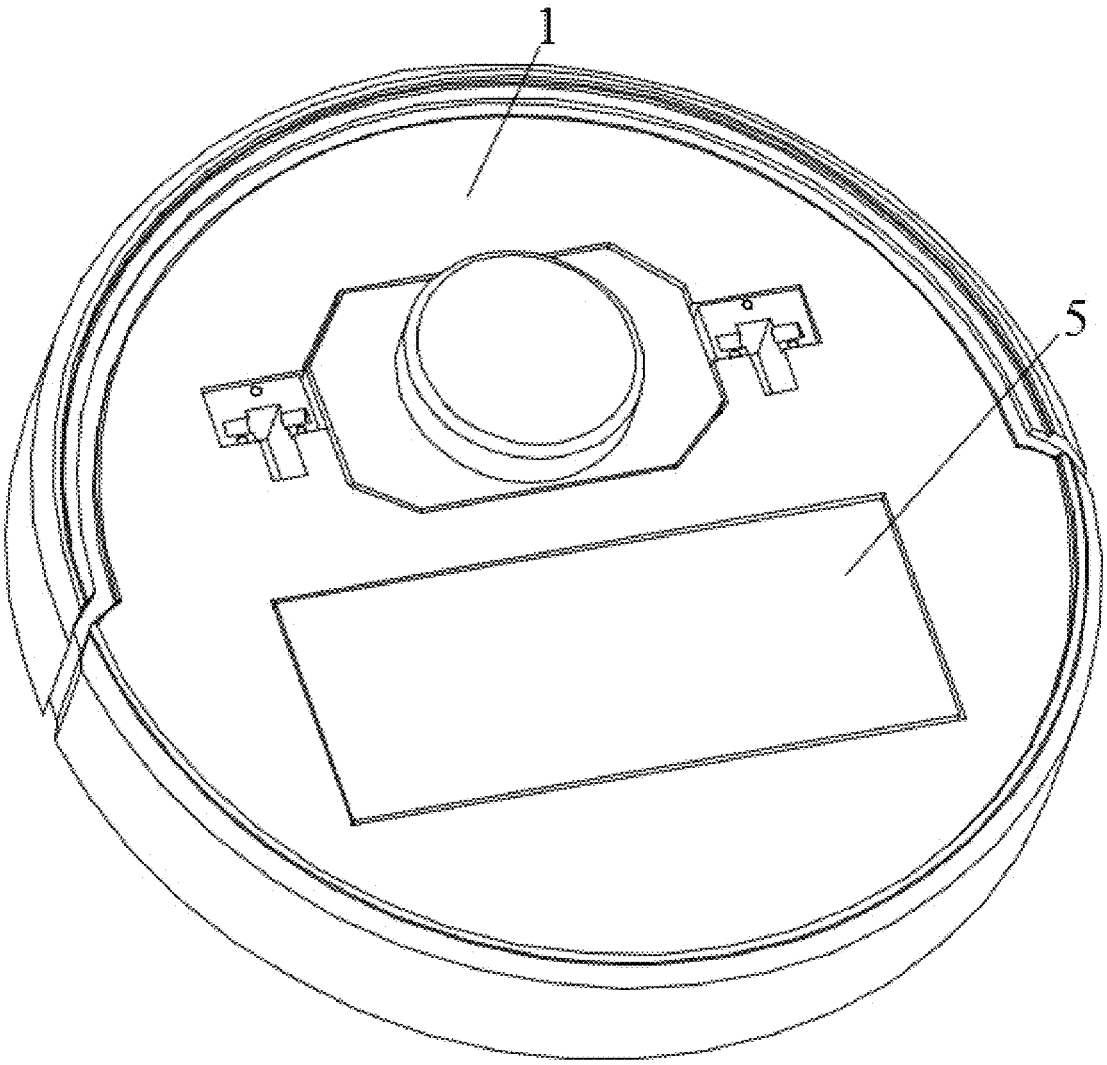
FIG. 2 is a schematic structural view of a machine body.

As shown in FIG. 1 and FIG. 2, FIG. 1 is a schematic structural view of a cleaning robot according to an embodiment of the present disclosure, and FIG. 2 is a schematic structural view of a machine body 1.

Figure 4:
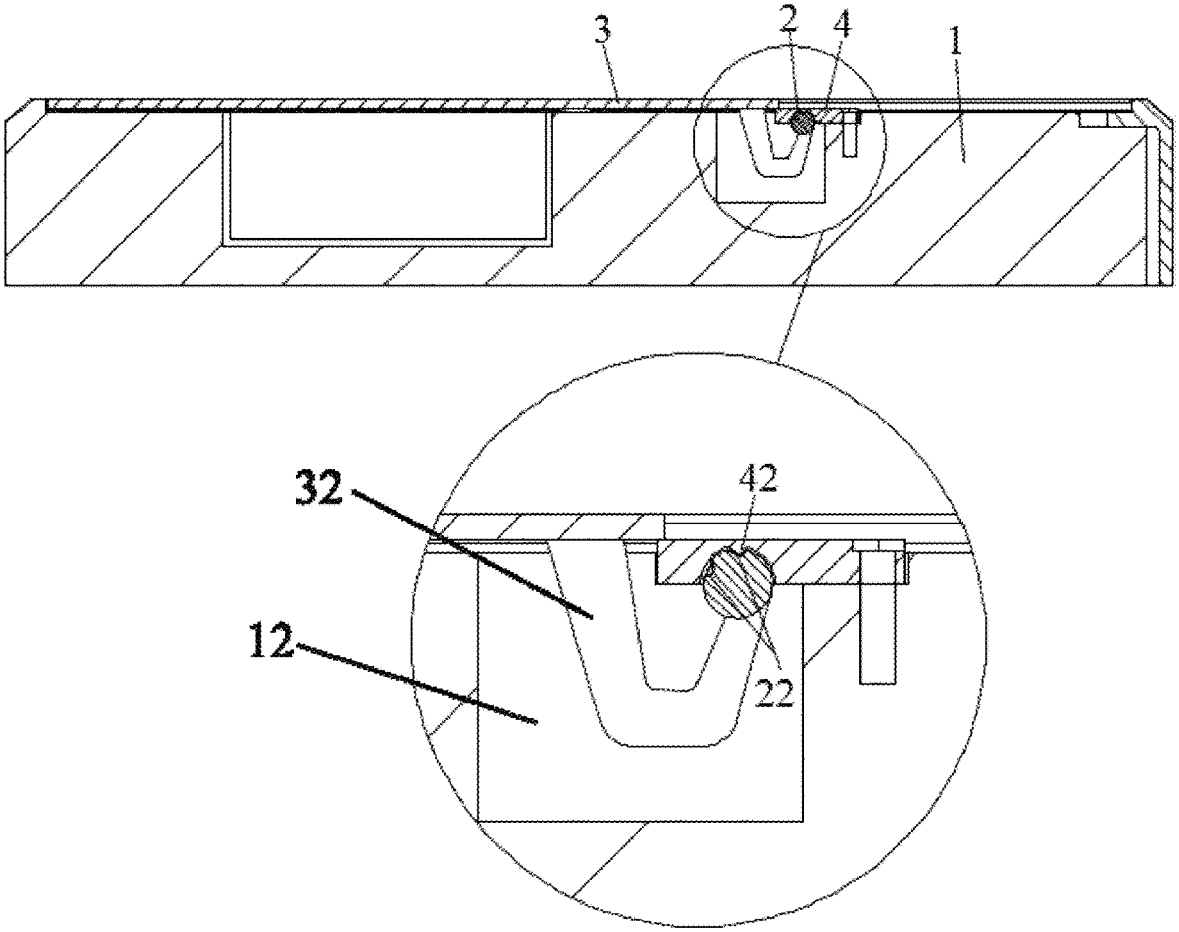
FIG. 4 is a schematic structural view of a cover in a closed state.

A cleaning robot of the embodiment of the present disclosure includes a machine body 1, a cover 3, a decorative plate 7, and a rotating component 2 (please see FIG. 4).

The machine body 1 is the main body of the cleaning robot, the machine body 1 may include an upper shell and a lower shell, between which modules such as a fan assembly, an air duct assembly and a control part may be provided. The upper shell may further be provided with a radar assembly 6 extending upwards, the radar assembly 6 may be positioned in a concave accommodation cavity defined in the top of the machine body 1. The upper shell also defines an opening, the opening may accommodate a dust box 5 or/and a water tank, and a traveling wheel assembly and a cleaning assembly may be positioned on the lower shell. During the running of the cleaning robot, the cleaning assembly continuously rotates to clean the surface to be cleaned that the cleaning robot has traveled, and the object to be cleaned is sucked into the dust box 5 by the action of the air duct assembly and the fan assembly.

The cover 3 is cooperating with the machine body 1 in an opening and closing manner, and in this embodiment, the cover 3 is positioned on the top of the machine body 1 and covers the opening of the machine body 1 in an opening and closing manner, so as to cover the dust box 5 or/and the water tank placed in the opening. When the cover 3 is opened, the dust box 5 or/and the water tank may be taken out, and when the cover 3 is closed, the cover 3 restricts and decorates the dust box 5 or/and the water tank. On the one hand, the cover 3 can eliminate the noise generated by the shaking of the dust box 5 or/and the water tank when the cleaning robot is running, and on the other hand, the cover 3 can shield the dust box 5 or/and the water tank for decoration. When it is necessary to clean garbage or replenish water, the dust box 5 or/and the water tank may be lifted out simply by turning up the cover 3, which is convenient to use. In other embodiments, the cover 3 may also be positioned at other positions of the machine body 1, and may shield and restrict a part of the machine body 1 in the opening and closing manner, and achieve the same or similar function.

The decorative plate 7 is positioned on the top of the machine body 1. The decorative plate 7 and the cover 3 cooperatively shield the top of the machine body 1.

Figure 3:
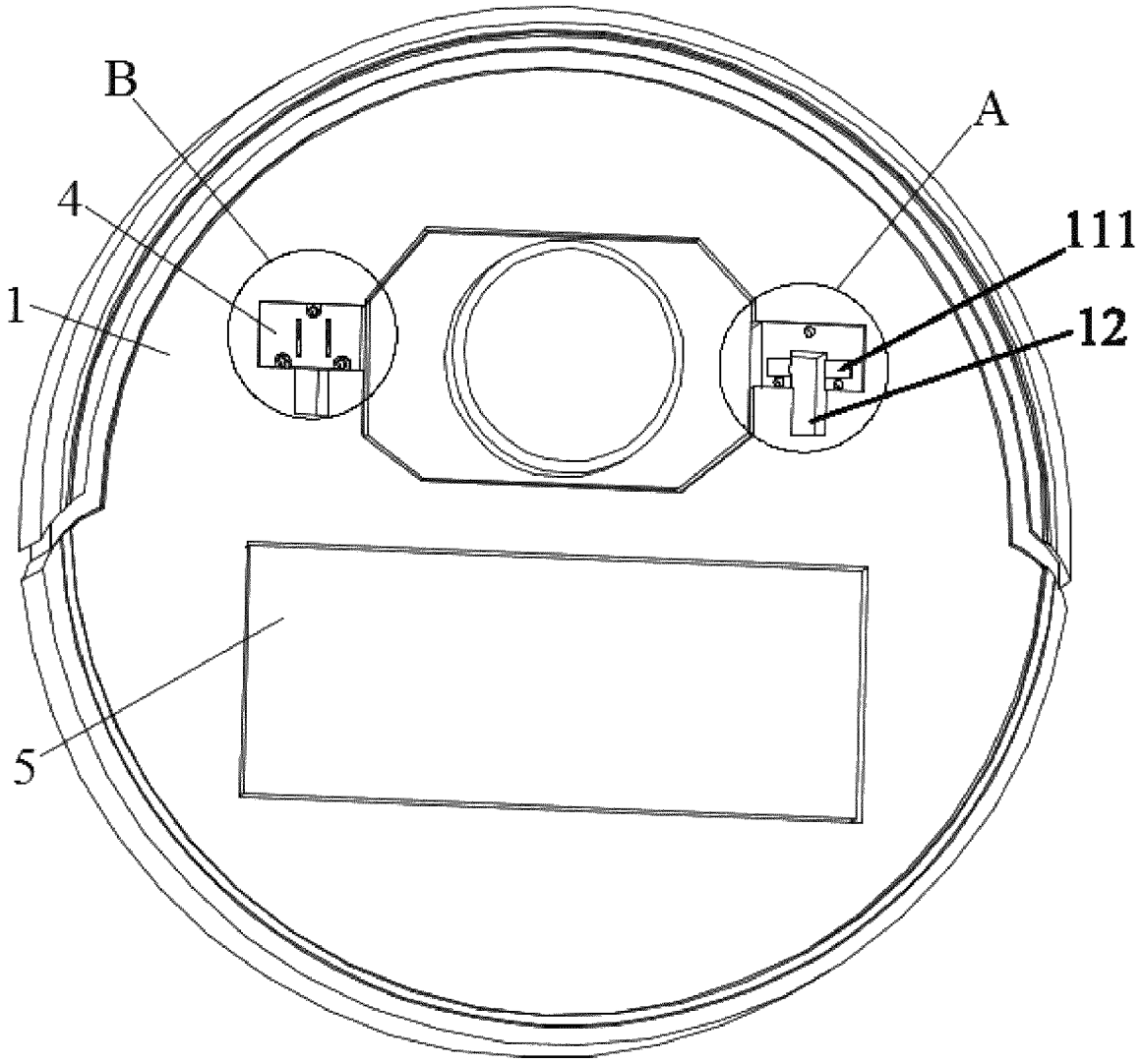
FIG. 3 is a schematic view illustrating the connection relationship between the machine body and a fixing component.
Figure 5:
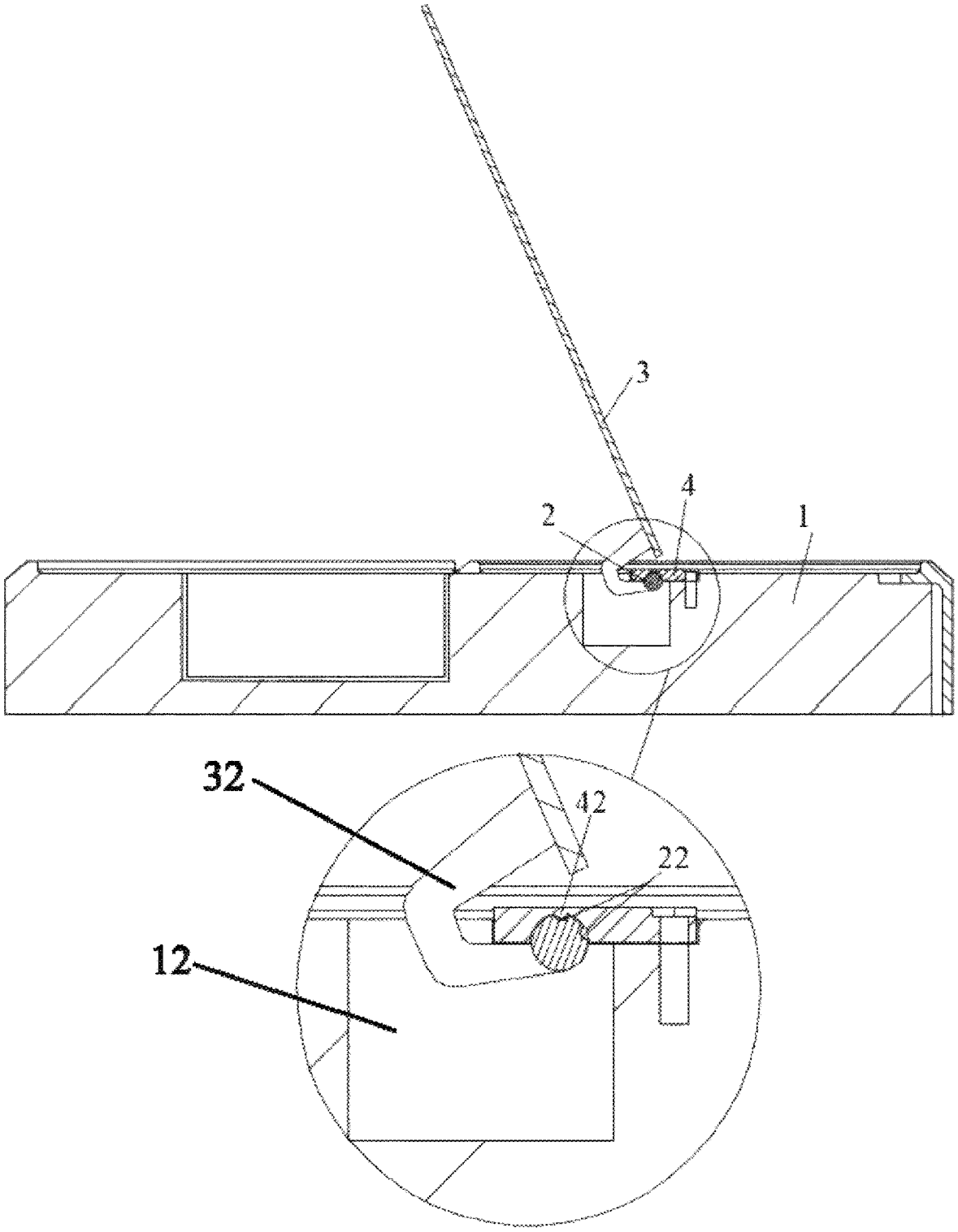
FIG. 5 is a schematic structural view of the cover in an open state.

As shown in FIG. 3 to FIG. 5, FIG. 3 is a schematic view illustrating the connection relationship between the machine body and the fixing component, FIG. 4 is a schematic structural view of the cover in the closed state, and FIG. 5 is a schematic structural view of the cover in the open state.

FIG. 4 and FIG. 5 show the opening and closing process of the cover 3, and the cover 3 may cooperate with the machine body 1 in an opening and closing manner by adopting the following structure.

The rotating component 2 includes an outer wall 21, the machine body 1 defines a mounting groove 11 therein, at least a part of the outer wall 21 is jointed with the mounting groove 11 to form a rotating pair, and the cover 3 is fixedly connected with the rotating component 2. In this way, the cover 3 can cooperate with the machine body 1 in an opening and closing manner.

Working principle: the cover 3 is fixedly connected to the rotating component 2, the mounting groove 11 is defined in the machine body 1, and the rotating component 2 is connected with the mounting groove 11 to form a rotating pair. The rotating component 2 includes an outer wall 21, and at least a part of the outer wall 21 is jointed with the mounting groove 11 to form the rotating pair, such that the cover 3 can cooperate with the machine body 1 in an opening and closing manner. As compared to the structure in which a through hole is defined in a rotating component and a rotating shaft is inserted into the through hole, this rotating structure solves problems of limited size of the rotating shaft and inconvenient installation. First, the rotating component 2 serves as a rotating shaft at the same time, which is simple in structure; second, the size of the rotating shaft may not be limited, which imposes a low strength requirement on the rotating shaft, and it is not easy to break and has a low failure rate; and third, it is unnecessary to insert the rotating shaft into the rotating component 2, which is convenient to install.

In order to facilitate the installation of the rotating component 2, a first sub-groove 41 and a second sub-groove 111 may be adopted to form the mounting groove 11 in combination. Specifically, the cleaning robot further includes a fixing component 4.

The fixing component 4 defines a first sub-groove 41, the machine body 1 defines a second sub-groove 111, and the fixing component 4 is detachably connected with the machine body 1, such that the first sub-groove 41 communicates with the second sub-groove 111 to form the mounting groove 11.

During installation, it is only necessary to place the rotating component 2 in the second sub-groove 111, and then arrange the fixing component 4 with the first sub-groove 41 at the position corresponding to the second sub-groove 111 for detachable connection. It is unnecessary to set installation spaces on both sides of the machine body 1 where the rotating components 2 is installed, and the rotating component 2 is installed up and down instead of being installed at both sides, thus saving space for the cleaning robot. The first sub-groove 41 and the second sub-groove 111 are both semi-cylindrical in shape. It is understood that, in other embodiments, the first sub-groove 41 and the second sub-groove 111 may also be replaced by a complete cylindrical mounting groove 11. In this case, the cover 3 may be divided into a first sub-cover and a second sub-cover, which are correspondingly located in the two mounting grooves 11 on the left and right sides of the cleaning robot. During installation, the rotating component 2 on the first sub-cover is inserted into the complete cylindrical mounting groove 11, and the second sub-cover is inserted into the complete cylindrical mounting groove 11 from the right side, thereby finishing the installation of rotational connection.

The fixing component 4 is detachably connected with the machine body 1, and in this embodiment, the fixing component 4 defines a plurality of through holes, and the machine body 1 also defines threaded holes corresponding to the through holes in position. The fixing component 4 is connected to the machine body 1 through threaded connection, so as to realize the detachable connection between the machine body 1 and the fixing component 4. In other embodiments, the fixing component 4 is an elastic fixing component 4, which may be made of rubber or other materials. In this case, one of the fixing component 4 and the machine body 1 defines a through hole, and the other of the fixing component 4 and the machine body 1 includes a protrusion matched with the through hole. The connection between the fixing component 4 and the machine body 1 is achieved by the engagement of the through hole and the protrusion, and the elastic fixing component 4 is convenient for insertion and installation. In yet another embodiment, the fixing component 4 may also be made of plastic or other materials. In this case, one of the fixing component 4 and the machine body 1 defines a through hole, the other of the fixing component 4 and the machine body 1 includes an elastic protrusion matched with the through hole, and the elastic protrusion may be a protrusion with a hook. The connection between the fixing component 4 and the machine body 1 is achieved by the engagement of the through hole and the elastic protrusion, and the elastic protrusion may be made of rubber, silica gel or other materials. In a modified embodiment, the fixing component 4 may be made of plastic or other materials, and one of the fixing component 4 and the machine body 1 defines a through hole, and the other of the fixing component 4 and the machine body 1 includes a plug-in part matched with the through hole. The plug-in part includes an extension rod and a hook, the extension rod is formed integrally with the fixing component 4, i.e., the plug-in part may also be made of plastic. One end of the extension rod is fixed with the fixing component 4, and the free end of the extension part is fixedly connected with the hook. The plug-in part may be inserted into the through hole via the hook to realize detachable connection, and the extension rod can be deformed when being plugged in and pulled out. The plug-in part may also be formed by a plurality of extension rods to form a deformable plug-in part.

Figure 10:
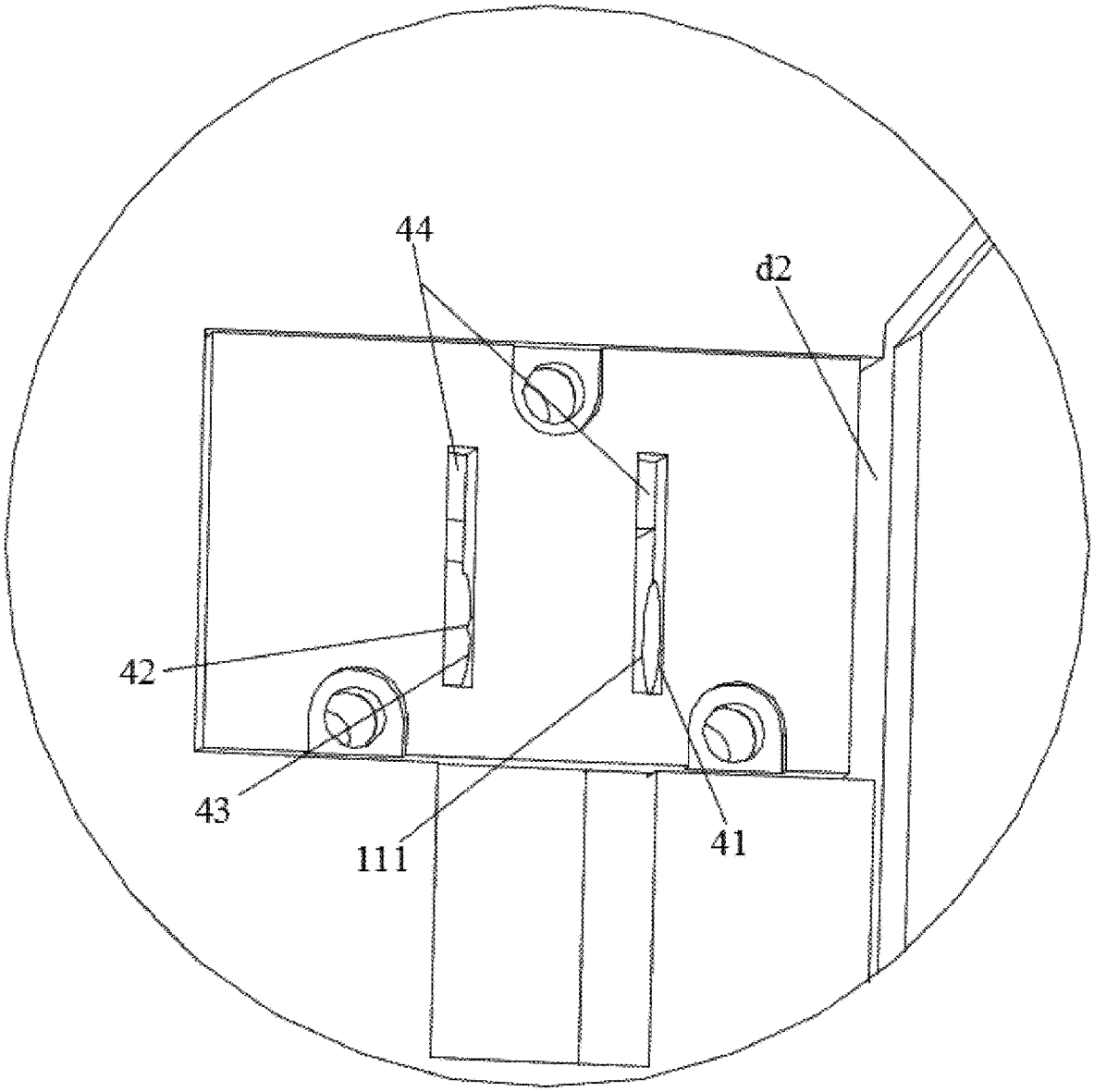
FIG. 10 is a partial enlarged view of an area B in FIG. 3.

The fixing component 4 may be embedded into the machine body 1 to avoid affecting the thickness of the whole machine. Considering that it is difficult to disassemble the embedded fixing component 4 from the machine body 1, the machine body 1 defines an embedded groove for accommodating the fixing component 4 and defines an accommodation cavity for accommodating the radar assembly 6, and the embedded groove is communicated with the accommodation cavity. Moreover, a transverse gap d2 is located between the fixing component 4 and the accommodation cavity, and the transverse gap d2 may make it convenient to take out or tilt out the fixing component 4. The transverse gap d2 is shown in FIG. 10, which is a partial enlarged view of an area B in FIG. 3.

In order to fix the cover 3 during rotation, one of the rotating component 2 and the fixing component 4 includes a limiting protrusion 42, and the other defines a limiting groove 22 configured to accommodate the limiting protrusion 42. When the rotating component 2 rotates until the limiting protrusion 42 is clamped into the limiting groove 22, the rotating component 2 stops rotating, and the cover 3 may be relatively fixed with the machine body 1 as the rotating component 2 stops rotating. Being relatively fixed means that the cover 3 may rotate relative to the machine body 1 when the force applied on the cover 3 exceeds a preset range, and the cover 3 may be fixed relative to the machine body 1 when the force is within the preset range.

Furthermore, the cover 3 may have more than two relative fixed positions during rotation. The cover 3 is plate-shaped, the cover 3 is fixedly connected with the rotating component 2, the rotating component 2 defines at least two limiting grooves 22 therein, and the at least two limiting grooves 22 are circumferentially spaced apart about the axis of the rotating component 2.

When the limiting protrusion 42 is clamped into one of the at least two limiting grooves 22, the cover 3 is in a closed state parallel to the horizontal plane, and when the limiting protrusion 42 is clamped into another one of the at least two limiting grooves 22, the cover 3 is in an open state forming a fixed angle with the horizontal plane.

In this embodiment, the limiting protrusion 42 is positioned on the fixing component 4 and the limiting groove 22 is defined in the rotating component 2. When the rotating component 2 on the cover 3 is positioned in the second sub-groove 111, the cover 3 connected with the rotating component 2 is placed on the top of the machine body 1, the plate-shaped cover 3 is parallel to the horizontal plane, and the limiting groove 22 of the rotating component 2 is facing vertically upward. Therefore, the fixing component 4 with the limiting protrusion 42 may be placed on the machine body 1, which is very convenient for installation. The cover 3 may be integrally connected with the rotating component 2. During installation, the rotating component 2 is directly placed in the second sub-groove 111, that is, the cover 3 is placed on the top of the machine body 1, and then the fixing component 4 is fixed. It greatly shortens the installation time, saves time and effort, does not need alignment, and provides a firmer connection structure, as compared to the case where a rotating shaft passes through the middle of the rotating component 2, and a user needs to hold the rotating component 2 with the cover 3 in one hand to align with the machine body 1, and insert the rotating shaft with the other hand. For the latter case, the force imposed to turn over the cover is all concentrated on the rotating shaft, which results in a high failure rate. For the former case, the force is expanded to the rotating component 2 and the mounting groove 11, which results in a low failure rate. It should be noted that, the rotating component 2 may also be set hollow. In another embodiment, the rotating component 2 may also be fixedly connected with the cover 3 by means of threaded connection or the like.

It is convenient for the plate-shaped cover 3 to shield the opening of the machine body 1 for containing the dust box 5, which greatly eliminates the noise caused by the up-and-down vibration of the dust box 5 during operation. When the cover 3 is in the state parallel to the horizontal plane, the cover 3 may cover the machine body 1, i.e., the cover 3 is in the closed state. When the cover 3 is in the state forming a fixed angle with the horizontal plane, the cover 3 may form a fixed angle with the machine body 1, i.e., the cover 3 is in the open state, which is convenient to take out the dust box 5 below the cover 3.

Of course, the cover 3 may also have only one relatively fixed position during rotation, and in this case, one limiting protrusion 42 and one limiting groove 22 are correspondingly positioned. Alternatively, the cover 3 may have multiple relatively fixed positions during rotation, and in this case, an equal number of limiting grooves 22 may be correspondingly set.

The fixed angle may be any value, and in some embodiments, the fixed angle is 30 to 180 degrees. Different fixed angles that are set may determine the opening angle of the cover 3, for example, three fixed angles of 30 degrees, 60 degrees and 75 degrees may be set.

In some embodiments, the machine body 1 defines a mounting recess 12. The mounting recess 12 is intersected with and communicated with the second sub-groove 111. The cover 3 includes a connecting part 32. The connecting part 32 is received in the mounting recess 12 and fixedly connected to the rotating component 2. The connecting part 32 is substantially U-shaped. The fixing component 4 partially covers the the mounting recess 12 and the connecting part 32. When the cover 3 is in the open state, the connecting part 32 pass through the mounting recess 12 and partially comes out though the mounting recess 12.

Figure 6:
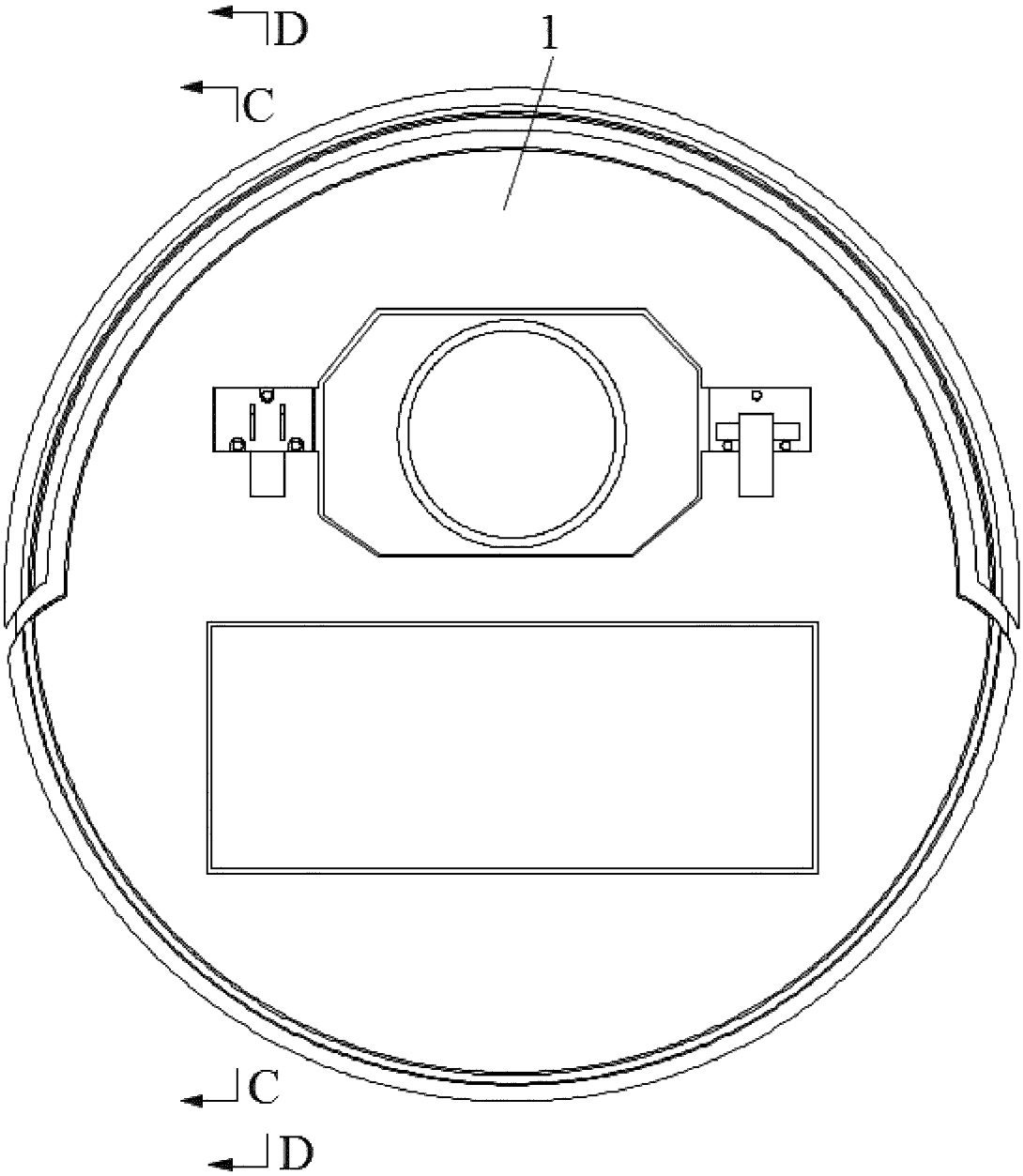
FIG. 6 is a top view of the machine body.
Figure 7:
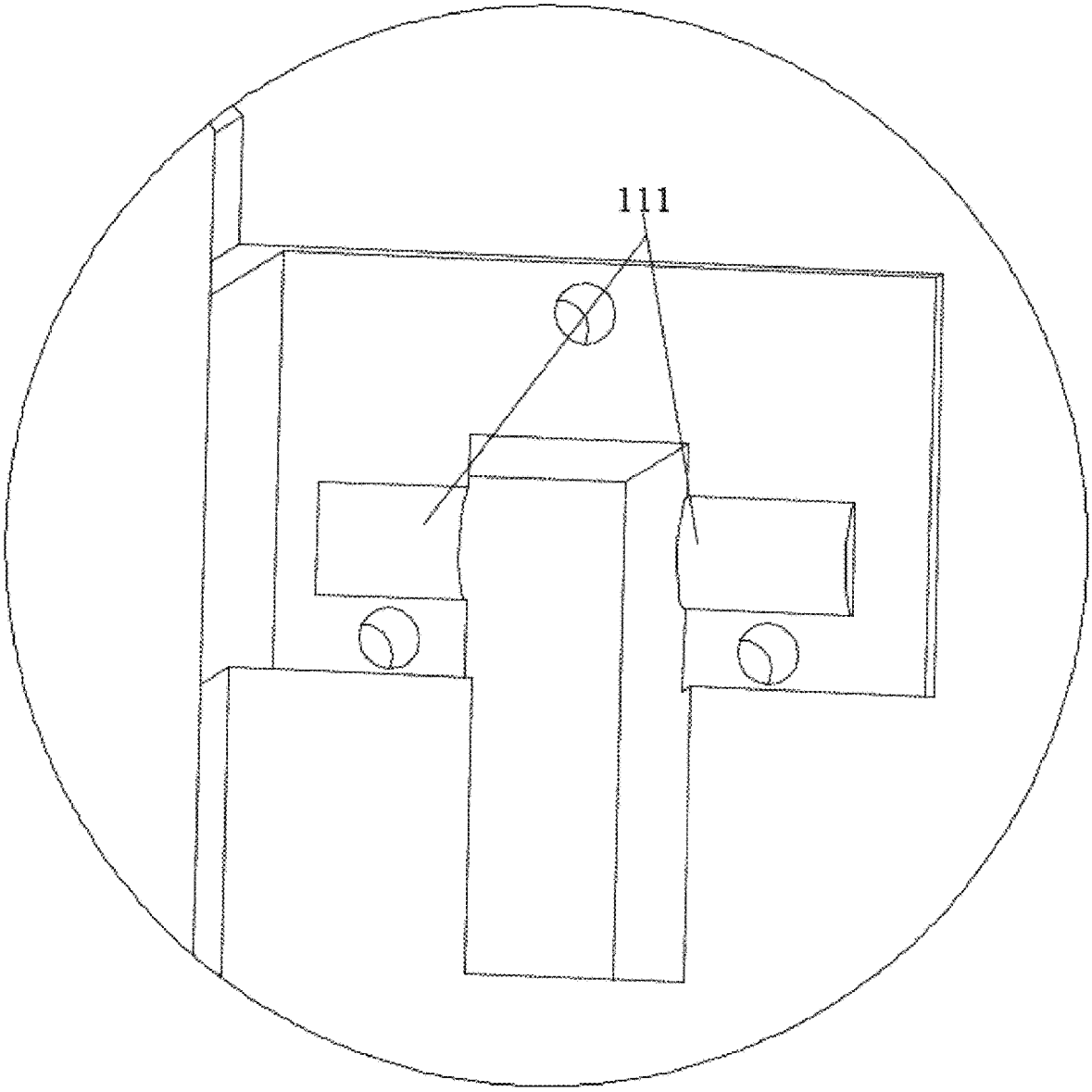
FIG. 7 is a partial enlarged view of an area A in FIG. 3.

As shown in FIG. 6 and FIG. 7, FIG. 6 is a top view of the machine body, and FIG. 7 is a partial enlarged view of the area A in FIG. 3.

FIG. 6 shows that both the left and right sides of the radar assembly 6 define the mounting grooves 11, the mounting grooves 11 may be matched with the rotating component 2, and the mounting groove 11 on each side consists of the first sub-groove 41 and the second sub-groove 111. The rotating component 2 is shown in FIG. 9.

The machine body 1 defines a semi-cylindrical second sub-groove 111, and the second sub-groove 111 on each side of the radar assembly 6 may be separately set, i.e., the second sub-groove 111 may be divided into two groove parts. With such arrangement, it is convenient for a middle annular flange 23 to match with a middle concave section 43, such that the cover 3 may rotate more easily, and the middle annular flange 23 and the middle concave section 43 are shown in FIG. 9 and FIG. 10. The fixing component 4 defines a semi-cylindrical first sub-groove 41, and when the rotating component 2 is detachably connected to the machine body 1, the first sub-groove 41 and the second sub-groove 111 are communicated with each other to form a complete cylindrical mounting groove 11 to fit the rotating component 2, and the rotating component 2 is shown in FIG. 9.

Figure 8:
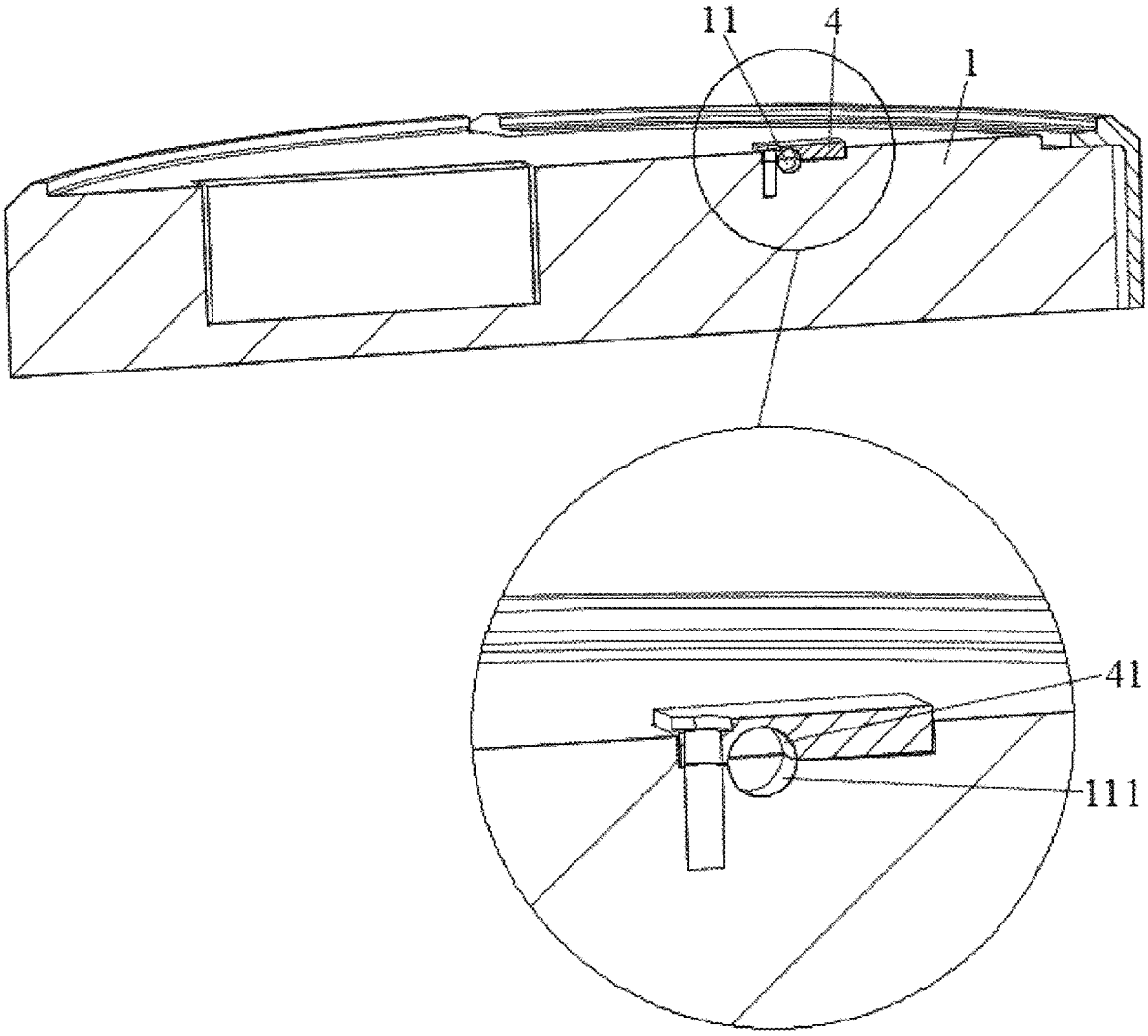
FIG. 8 is a cross-sectional view taken along a line C-C in FIG. 6.
Figure 9:
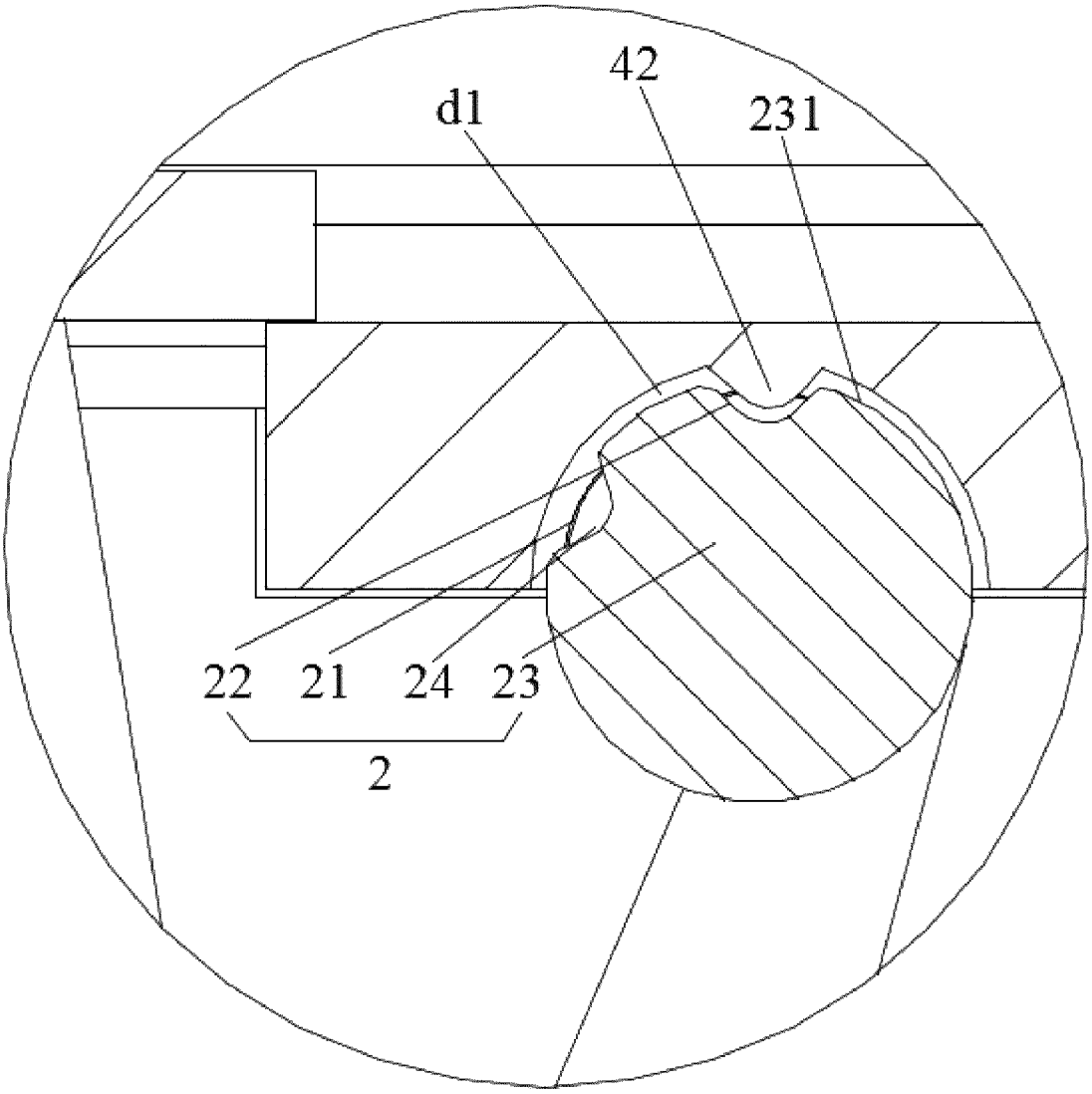
FIG. 9 is a schematic view illustrating the connection relationship between a limiting protrusion and a limiting groove.

As shown in FIG. 8 to FIG. 10, FIG. 8 is a cross-sectional view taken along a line C-C in FIG. 6, FIG. 9 is a schematic view illustrating the connection relationship between the limiting protrusion and the limiting groove, and FIG. 10 is a partial enlarged view of an area B in FIG. 3.

The cover 3 may be mounted on the mounting groove 11 through the rotating component 2.

The rotating component 2 includes the middle annular flange 23 and connecting parts 24 located at two ends of the middle annular flange 23. The outer wall 21 of the rotating component 2 includes a first sidewall 231 of the middle annular flange 23 and a second sidewall of the connecting part 24, i.e., the outer wall 21 refers to the outer surface of the side part of the rotating component 2. Both of the first sidewall 231 and the second sidewall are cylindrical surfaces. During installation, the second sidewall of the connecting part 24 is jointed with the mounting groove 11 to form a rotating pair. The outer wall 21 of the rotating component 2 further includes the first sidewall 231 of the middle annular flange 23, and at least a part of the outer wall 21 is jointed with the mounting groove 11 to form a rotating pair. In this embodiment, the second sidewalls of the connecting parts 24 on two sides of the middle annular flange 23 are jointed with the mounting groove 11 to form rotating pairs, i.e., a part of the outer wall 21 is jointed with the mounting groove 11 to form a rotating pair. In other embodiments, it may be all cylindrical outer walls 21 that are jointed with the mounting groove 11, for example, the rotating component 2 not provided with the middle annular flange 23, and the connecting position of the cover 3 and the rotating component 2 is located at two ends of the rotating component 2. At this time, the second sidewall of the connecting part 24, i.e., all the outer wall 21 of the rotating component 2, is jointed with the mounting groove 11.

Considering that the cooperation between the limiting protrusion 42 and the limiting groove 22 will drive the fixing component 4 with the limiting groove 22 to deform and for purpose of convenience, the rotating component 2 is provided with the limiting groove 22 thereon. The rotating component 2 is provided with the middle annular flange 23 thereon, the rotating component 2 includes the middle annular flange 23 and the connecting parts 24 located at two ends of the middle annular flange 23, and the limiting groove 22 is defined in the middle annular flange 23. The first sub-groove 41 further includes a middle concave section 43, the limiting protrusion 42 is located in the middle concave section 43, and the middle annular flange 23 is matched with the middle concave section 43. The arrangement of the middle annular flange 23 facilitates the arrangement of the limiting groove 22, and the arrangement of the middle concave section 43 makes it convenient to match with the middle annular flange 23. A vertical gap d1 may exist between the middle concave section 43 and the middle annular flange 23, which reduces the amount of deformation of the middle concave section 43 required when the rotating component 2 rotates. That is, the vertical gap d1 reduces the acting force required for the rotation of the cover 3, thereby making it easier to open and close, convenient to use and providing better user experience. Of course, in other embodiments, the middle concave section 43 may also be jointed with the middle annular flange 23.

In order to further facilitate the rotation of the rotating component 2, the fixing component 4 defines strip-shaped holes 44, and the strip-shaped holes 44 are located at two ends of the middle concave section 43. The rotating component 2 has a horizontal transverse axis, the strip-shaped holes 44 are arranged longitudinally along the horizontal plane, and the arrangement of the strip-shaped holes 44 makes the fixing component 4 easier to deform when the rotating component 2 rotates.

In order to further facilitate the rotation of the rotating component 2, the middle annular flange 23 includes a cylindrical first sidewall 231, and the limiting groove 22 is smoothly connected with the first sidewall 231. The smooth connection makes it easier for the limiting protrusion 42 to slide out of the limiting groove 22. Smooth connection is a connection mode in which two objects connected transitions in the form of curved surfaces or the like.

Considering that it is inconvenient to disassemble the fixing component 4 after it is embedded, the fixing component 4 defines a transverse gap d2, which may make it convenient to take out or tilt out the fixing component 4. When the fixing component 4 is threadedly connected with the machine body 1, a screwdriver may be inserted into the transverse gap d2 to tilt out the fixing component 4 after removing the screws, which is convenient and does not need to turn the whole machine over. When the fixing component 4 is inserted into the machine body 1, the fixing component 4 may be tilted out or pulled out directly through the transverse gap d2.

Figure 11:
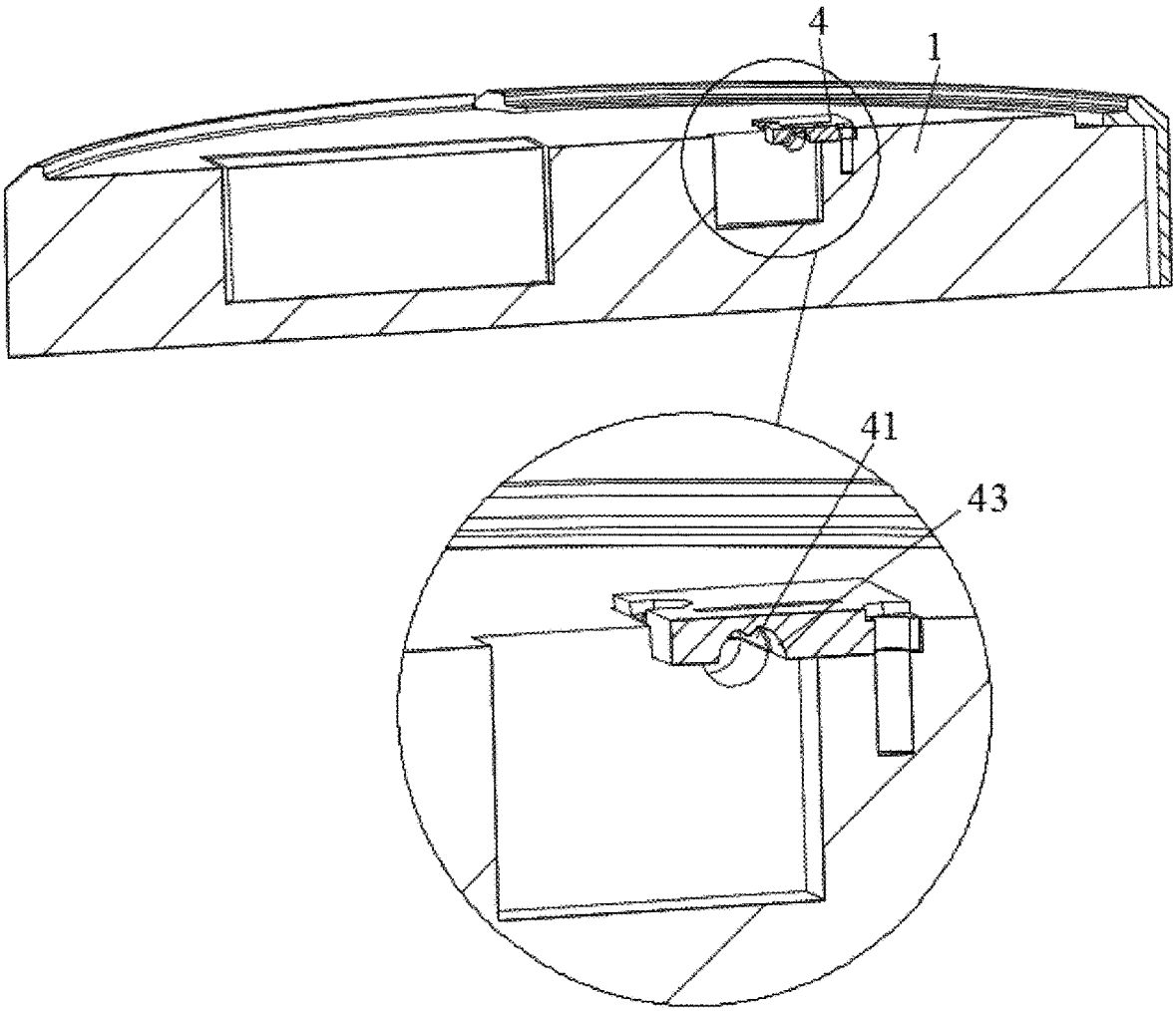
FIG. 11 is a cross-sectional view taken along a line D-D in FIG. 6.
Figure 12:
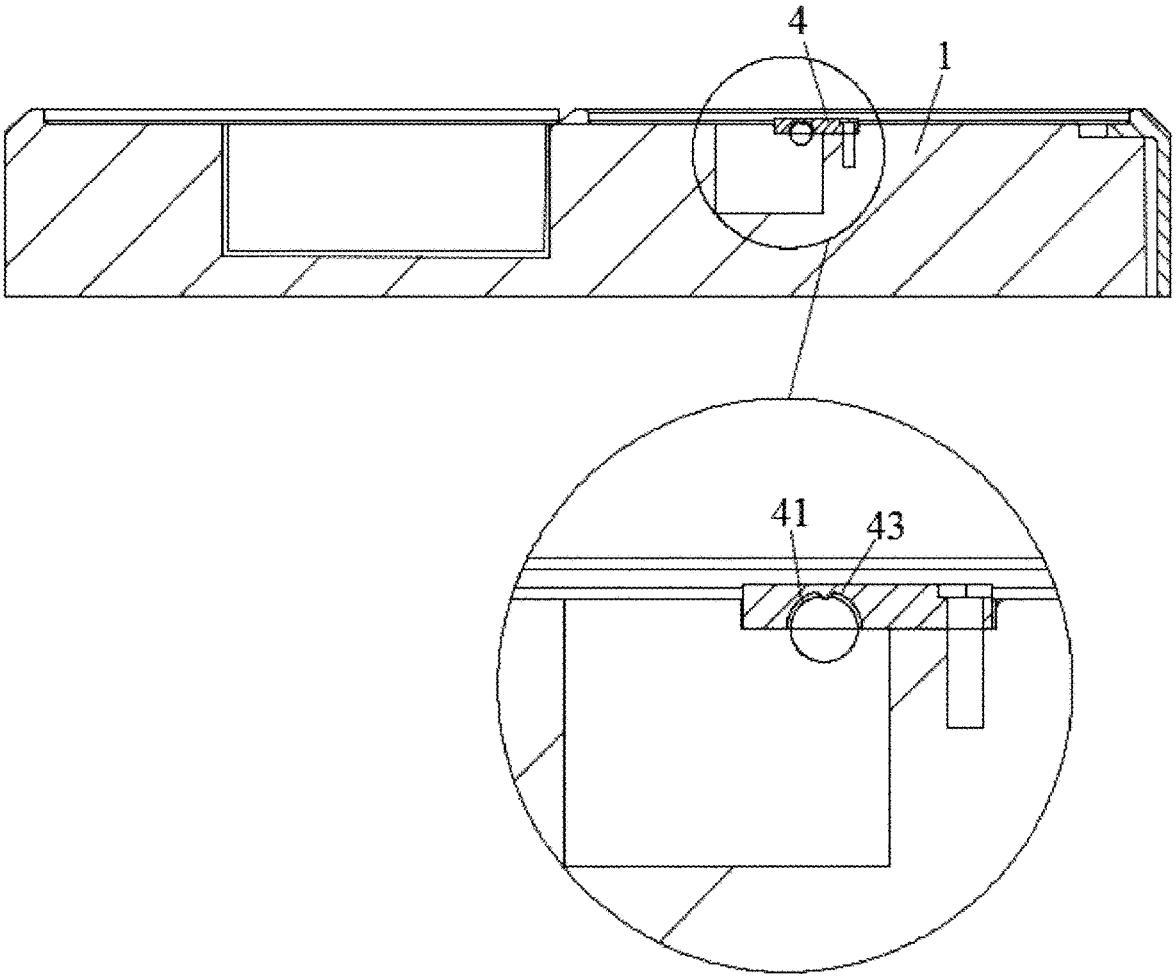
FIG. 12 is a schematic view illustrating the connection relationship between a middle concave section and a first sub-groove.

As shown in FIG. 11 and FIG. 12, FIG. 11 is a cross-sectional view taken along a line D-D in FIG. 6, and FIG. 12 is a schematic view illustrating the connection relationship between the middle concave section and the first sub-groove.

For a better understanding of the connection relationship between the middle concave section 43 and the first sub-groove 41, FIG. 11 shows the cleaning robot cut along the line D-D, and FIG. 12 shows the engagement relationship between the cover 3 and the machine body 1. Obviously, the diameter of the middle concave section 43 is larger than the diameter of the first sub-groove 41. In this embodiment, the middle concave section 43 has the shape of a cylindrical surface as shown, and the cross section of the middle concave section 43 may be semicircular. In other embodiments, the cross section of the middle concave section 43 may be fan-shaped. In yet another embodiment, the middle concave section 43 may also have the shape of an elliptic cylinder, a hyperbolic cylinder or a parabolic cylinder.

As compared to the prior art, the cleaning robot of the embodiment of the present disclosure is provided with the rotating component 2, the cover 3 is fixedly connected to the rotating component 2, the mounting groove 11 is defined in the machine body 1, and the rotating component 2 is connected with the mounting groove 11 to form a rotating pair. In this way, the cover 3 can cooperate with the machine body 1 in an opening and closing manner. Specifically, the rotating component 2 includes the outer wall 21, and at least a part of the outer wall 21 is jointed with the mounting groove 11 to form a rotating pair. As compared to the structure in which a through hole is defined in the rotating component 2 and a rotating shaft is inserted into the through hole, this rotating structure solves the problems of limited size of the rotating shaft and inconvenient installation. First, the rotating component 2 serves as a rotating shaft at the same time, which is simple in structure; second, the size of the rotating shaft may not be limited, which imposes a low strength requirement on the rotating shaft, and it is not easy to break and has a low failure rate; and third, it is unnecessary to insert the rotating shaft into the rotating component 2, which is convenient to install. The cleaning robot of the embodiment of the present disclosure features a simple structure, a low failure rate, convenient installation and convenient use.

What described above are only the embodiments of the present disclosure, and the descriptions of the embodiments are more specific and detailed, but are not intended to limit the scope of the present disclosure. It should be noted that, on the premise of not deviating from the conception of the present disclosure, a number of deformations and improvements can also be made by ordinary person skilled in the art, which are within the protection scope of the present disclosure.

What is claimed is:

1. A cleaning robot, comprising:

a machine body;

a rotating component comprising an outer wall;

a cover, fixedly connected with the rotating component, the cover capable of cooperating with the machine body in an opening and closing manne; and a fixing component defining a first sub-groove, the machine body defining a second sub-groove, the fixing component detachably connected with the machine body, the first sub-groove communicated with the second sub-groove to form a mounting groove, the rotating component received in the mounting groove, and at least a part of the outer wall jointed with the mounting groove to form a rotating pair.

2. The cleaning robot of claim 1, wherein the fixing component is an elastic fixing component, and the fixing component is inserted into the machine body.

3. The cleaning robot of claim 1, wherein one of the rotating component and the fixing component comprises a limiting protrusion, the other of the rotating component and the fixing component defines a limiting groove configured to accommodate the limiting protrusion, and when the rotating component rotates until the limiting protrusion is clamped into the limiting groove, the rotating component stops rotating.

4. The cleaning robot of claim 3, wherein the cover is plate-shaped, the rotating component defines at least two limiting grooves, and the at least two limiting grooves are defined on the outer wall of the rotating component and circumferentially spaced apart about an axis of the rotating component;

the fixing component comprises the limiting protrusion;

when the limiting protrusion is clamped into one of the at least two limiting grooves, the cover is in a closed state parallel to a horizontal plane, and when the limiting protrusion is clamped into another of the at least two limiting grooves, the cover is in an open state forming a fixed angle with the horizontal plane.

5. The cleaning robot of claim 4, wherein the fixed angle is 30 to 180 degrees.

6. The cleaning robot of claim 3, wherein the rotating component comprises a middle annular flange, the limiting groove is defined in the middle annular flange, the first sub-groove comprises a middle concave section, the limiting protrusion is located on the middle concave section, and the middle annular flange is matched with the middle concave section.

7. The cleaning robot of claim 6, wherein a vertical gap is defined between the middle concave section and the middle annular flange.

8. The cleaning robot of claim 6, wherein the fixing component defines strip-shaped holes located at two ends of the middle concave section, the rotating component comprises a horizontal transverse axis, and the strip-shaped holes are arranged longitudinally along the horizontal plane.

9. The cleaning robot of claim 6, wherein the middle annular flange comprises a cylindrical first sidewall, and the limiting groove is smoothly connected with the first sidewall.

10. The cleaning robot of claim 6, wherein the rotating component comprises two connecting parts located at two ends of the middle annular flange, the middle annular flange comprises a first sidewall, each connecting part comprises a second sidewall, two second sidewalls of the two connecting parts are jointed with the mounting groove to form the rotating pair, and the outer wall comprises the first sidewall and the two second sidewalls.

11. The cleaning robot of claim 1, further comprising a radar assembly, the machine body defining a concave accommodation cavity, the radar assembly positioned in the concave accommodation cavity, and a transverse gap is located between the fixing component and the accommodation cavity.

12. The cleaning robot of claim 11, wherein the machine body defines an embedded groove, and the fixing component is received in the embedded groove.

13. The cleaning robot of claim 1, wherein the machine body defines a mounting recess, the mounting recess is intersected with and communicated with the second sub-groove, the cover comprises a connecting part, the connecting part is received in the mounting recess and fixedly connected to the rotating component, and the fixing component partially covers the mounting recess and the connecting part.

14. The cleaning robot of claim 13, wherein the connecting part is U-shaped.

15. The cleaning robot of claim 1, wherein the first sub-groove and the second sub-groove are both semi-cylindrical in shape, and the mounting groove is cylindrical in shape.

16. A cleaning robot, comprising:

a machine body;

a rotating component comprising an outer wall;

a cover, fixedly connected with the rotating component, the cover capable of cooperating with the machine body in an opening and closing manner; and a fixing component defining a first sub-groove, the machine body defining a second sub-groove, the fixing component detachably connected with the machine body, the first sub-groove communicated with the second sub-groove to form a mounting groove, the rotating component received in the mounting groove, at least a part of the outer wall jointed with the mounting groove to form a rotating pair, one of the rotating component and the fixing component comprising a limiting protrusion, the other of the rotating component and the fixing component defining at least two limiting grooves configured to accommodate the limiting protrusion, the at least two limiting grooves positioned around the outer wall of the rotating component and circumferentially spaced apart about an axis of the rotating component, and when the limiting protrusion is clamped into one of the at least two limiting grooves, the cover is in a closed state parallel to a horizontal plane, and when the limiting protrusion is clamped into another of the at least two limiting grooves, the cover is in an open state forming a fixed angle with the horizontal plane.

17. The cleaning robot of claim 16, wherein the rotating component comprises a middle annular flange, the first sub-groove comprises a middle concave section, the middle annular flange is matched with the middle concave section, one of the middle annular flange and the middle concave section comprises the limiting protrusion, and the other of the middle annular flange and the middle concave section defines the at least two limiting grooves.

18. The cleaning robot of claim 17, wherein the fixing component defines strip-shaped holes located at two ends of the middle concave section, the rotating component comprises a horizontal transverse axis, and the strip-shaped holes are arranged longitudinally along the horizontal plane.

19. The cleaning robot of claim 17, wherein the rotating component comprises two connecting parts located at two ends of the middle annular flange, the middle annular flange comprises a first sidewall, each connecting part comprises a second sidewall, two second sidewalls of the two connecting parts are jointed with the mounting groove to form the rotating pair, and the outer wall comprises the first sidewall and the two second sidewalls.

20. The cleaning robot of claim 16, wherein the first sub-groove and the second sub-groove are both semi-cylindrical in shape, and the mounting groove is cylindrical in shape.

* * * * *